US010680373B2

(12) United States Patent
Cheng et al.

(10) Patent No.: US 10,680,373 B2
(45) Date of Patent: Jun. 9, 2020

(54) ELECTRICAL CONTACT OF ELECTRICAL CONNECTOR

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventors: Shan-Yong Cheng, New Taipei (TW); Tzu-Yao Hwang, New Taipei (TW)

(73) Assignees: FU DING PRECISION COMPONENT (SHEN ZHEN) Co., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/358,669

(22) Filed: Mar. 19, 2019

(65) Prior Publication Data

US 2019/0288432 A1 Sep. 19, 2019

(30) Foreign Application Priority Data

Mar. 19, 2018 (CN) ..... 2018 1 0225930

(51) Int. Cl.

| | |
|---|---|
| ***H01R 24/00*** | (2011.01) |
| ***H01R 13/24*** | (2006.01) |
| ***H01R 33/74*** | (2006.01) |
| ***H01R 13/50*** | (2006.01) |
| ***H01R 13/646*** | (2011.01) |
| *H01R 12/71* | (2011.01) |

(52) U.S. Cl.

CPC ..... *H01R 13/2442* (2013.01); *H01R 13/50* (2013.01); *H01R 13/646* (2013.01); *H01R 33/74* (2013.01); *H01R 12/716* (2013.01)

(58) Field of Classification Search

CPC .. H01R 13/2442; H01R 12/716; H01R 33/74; H01R 12/707; H01R 13/50

USPC ..... 439/66, 626, 879

See application file for complete search history.

(56) References Cited

U.S. PATENT DOCUMENTS 6,164,978 A * 12/2000 McHugh ..... H01R 12/52 439/66
6,179,624 B1 1/2001 McHugh et al.
6,955,572 B1 * 10/2005 Howell ..... H01R 13/2442 439/862

(Continued)

FOREIGN PATENT DOCUMENTS

CN 2706906 Y 6/2005
CN 2916984 Y 6/2007

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

A plurality of contact are received within the corresponding passageways of the insulative housing of an electrical connector, respectively. Each contact has juxtaposed first body and second body angled with each other via a linking section connected therebetween. A resilient spring arm extends upwardly from the first body, and includes a wide plate section adjacent to the first body, a bulged contacting section at a top thereof, and a narrow connecting section therebetween. The spring arm is asymmetric with regard to a centerline of the spring arm for avoiding interference with a standoff around a neighboring passageway in a neighboring row.

20 Claims, 11 Drawing Sheets

(56) References Cited

U.S. PATENT DOCUMENTS

| | | | | |
|---|---|---|---|---|
| 10,084,252 | B1 * | 9/2018 | Ju | H01R 12/707 |
| 2006/0040518 | A1 * | 2/2006 | Ma | H01R 13/2442 439/66 |
| 2008/0160841 | A1 * | 7/2008 | Polnyi | H01R 13/2435 439/842 |
| 2010/0015861 | A1 * | 1/2010 | Zhang | H05K 7/1007 439/733.1 |
| 2011/0014816 | A1 * | 1/2011 | Fan | H01R 12/57 439/626 |
| 2012/0028502 | A1 * | 2/2012 | Yeh | H01R 12/57 439/626 |
| 2012/0202384 | A1 * | 8/2012 | Liaw | H01R 12/57 439/626 |
| 2013/0237066 | A1 * | 9/2013 | Yeh | H01R 13/2457 439/65 |
| 2014/0134853 | A1 * | 5/2014 | Chang | H01R 13/6597 439/68 |
| 2014/0154918 | A1 * | 6/2014 | Chang | H01R 13/6585 439/607.01 |
| 2019/0288431 | A1 * | 9/2019 | Hwang | H01R 12/716 |
| 2019/0288432 | A1 * | 9/2019 | Cheng | H01R 13/2442 |
| 2019/0288454 | A1 * | 9/2019 | Hwang | H01R 13/2442 |

* cited by examiner

ELECTRICAL CONTACT OF ELECTRICAL CONNECTOR

BACKGROUND OF THE INVENTION

1. Field of the Invention

The present invention relates generally to an electrical contact, and more particularly to the electrical contact with structures meeting impedance requirements. This application relates to two other copending applications with Ser. Nos. 16/355,857 and 16/357,283 both filed Mar. 18, 2019.

2. Description of Related Arts

U.S. Pat. No. 8,454,373 discloses en electrical contact of an electrical connector for use with a CPU (Central Processing Unit). The contact includes two juxtaposed and mutually angled parts, of which one has the resilient upwardly extending contacting section and the other has the stiff downwardly extending tail section. The feature of such patent is to provide the barbed structure on two lateral outer sides of the these two parts, respectively, for enhancing the retention force thereof compared with the earlier prior art having the barbed structure only on the part having the tail section. Anyhow, some unwelcomed deviation away from the regulated 85+/−15Ω of the contact occurs due to the positions and the dimensions of the contacting section and the tail section disadvantageously. Understandably, the wider the spring arm is, the stiffer the spring arm is that may be unwelcomed; in opposite, the wider the spring is, the lower the impedance of the spring arm is that may be welcomed. Therefore, it is also required to get a balance between the resiliency of the spring arm with the contacting section at the free end thereof and the desired lower impedance thereof during design the configuration of the spring arm and its associated contacting section thereof.

An improvement upon the spring arm and the associated contacting section at the free end thereof, corresponding to the two mutually angled parts, is desired.

SUMMARY OF THE INVENTION

An object of the invention is to provide an electrical connector with an insulative housing having opposite top and bottom faces thereof, and therein a plurality of passageways each extending through both the opposite top and bottom faces in the vertical direction. A plurality of contact are received within the corresponding passageways, respectively. Each contact has juxtaposed first body and second body perpendicular to each other via a linking section connected therebetween viewed in the vertical direction. A spring arm extends upwardly from the first body and includes a plate/base section adjacent to the first body, a narrow/curved connecting/middle section, and an enlarged bulged contacting section at a free end thereof. The arrangement of the contacts is to have the neighboring contacts closer to each other either in a front-to-back direction or a transverse direction perpendicular to the front-to-back direction during operation for increasing mutual capacitance effect to lower the impedance.

DETAILED DESCRIPTION OF THE PREFERRED EMBODIMENT

Figure 1:
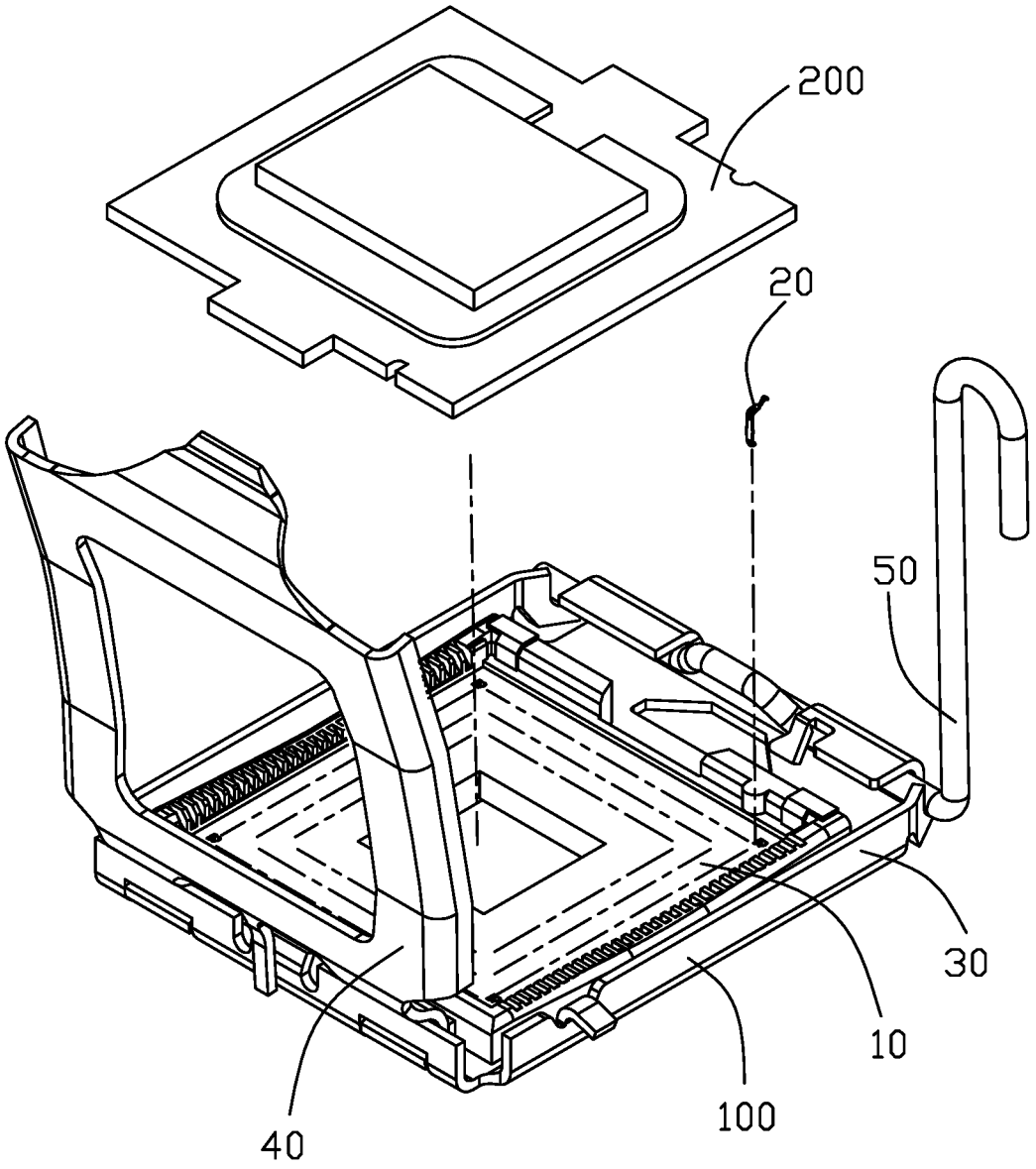
FIG. 1 is a perspective view of an electrical connector and the electronic package adapted to be received therein, according to a first embodiment of the present invention.
Figure 2:
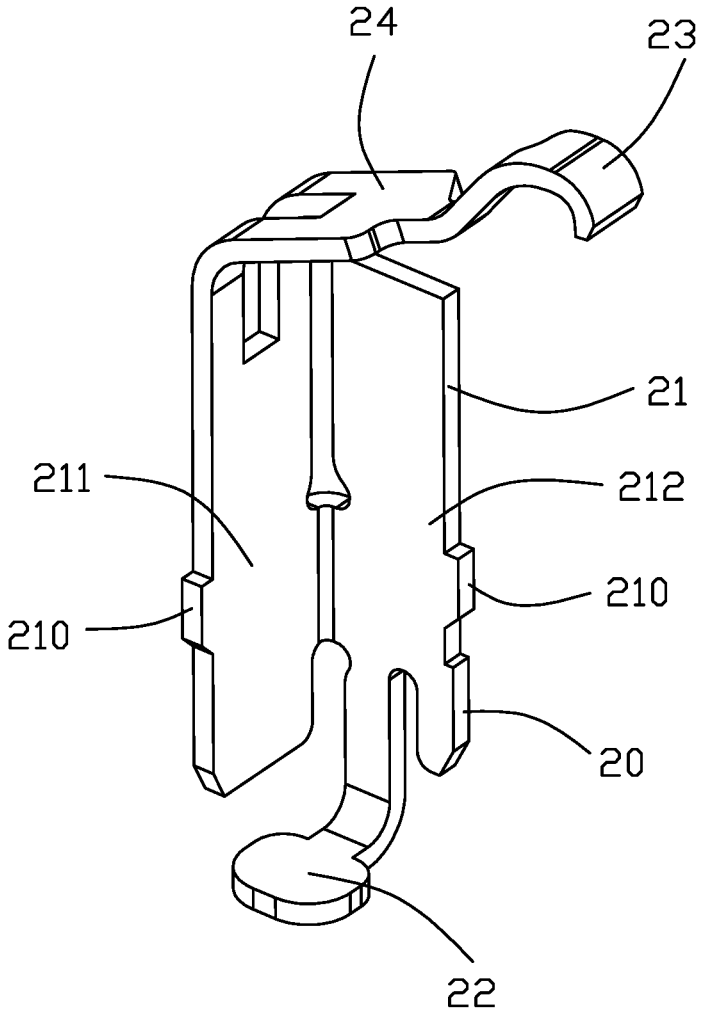
FIG. 2 is a perspective view of the electrical contact of the electrical connector of FIG. 1.

The electrical connector 100 connects the electronic package 200 to the printed circuit board 300. The connector 100 includes an insulative housing 10 with a plurality of passageways 11 extending therethrough to receive the corresponding contacts 20, respectively. The connector 100 further includes a metallic stiffener 30 surrounding the housing 10, and the load plate 40 and the lever 50 respectively pivotally mounted to two opposite ends of the stiffener 101 wherein the lever 50 is used to fasten the load plate 40 in position. Notably, the housing 10 defines a front-to-back/first direction Y and a transverse/second direction X perpendicular to each other and commonly perpendicular to the vertical direction Z. In this embodiment, the load plate 40 and the lever 50 are located at opposite ends of the stiffener 30 in the front-to-back direction. Alternately, such arrangement made along the transverse direction or even in an oblique manner with respective to those directions is feasible.

The housing 10 forms opposite top face and bottom face. A plurality of standoffs 12 are formed on the top face and respectively located by the corresponding passageways 11. The contacts 20 are arranged in matrix along the front-to-back direction Y and the transverse direction X. Each contact 20 includes a retaining part received within the corresponding passageway 11, a soldering tail 22 around a bottom portion for mounting to the printed circuit board 300 via a solder ball (not labeled), and a contacting section 23 around a top portion for contacting the electronic package 200. The retaining part 21 includes a first body 211 and a second body 212 angled with each other. In this embodiment, the angle between the first body 211 and the second body 212 is right angle. The first body 211 and the second body 212 include barbed structures 210 on corresponding lateral outer edges for engagement with the passageway. A linking section 213 is connected between the first body 211 and the second body 212. The soldering tail 22 is connected to a bottom portion of the second body 212.

Figure 3:
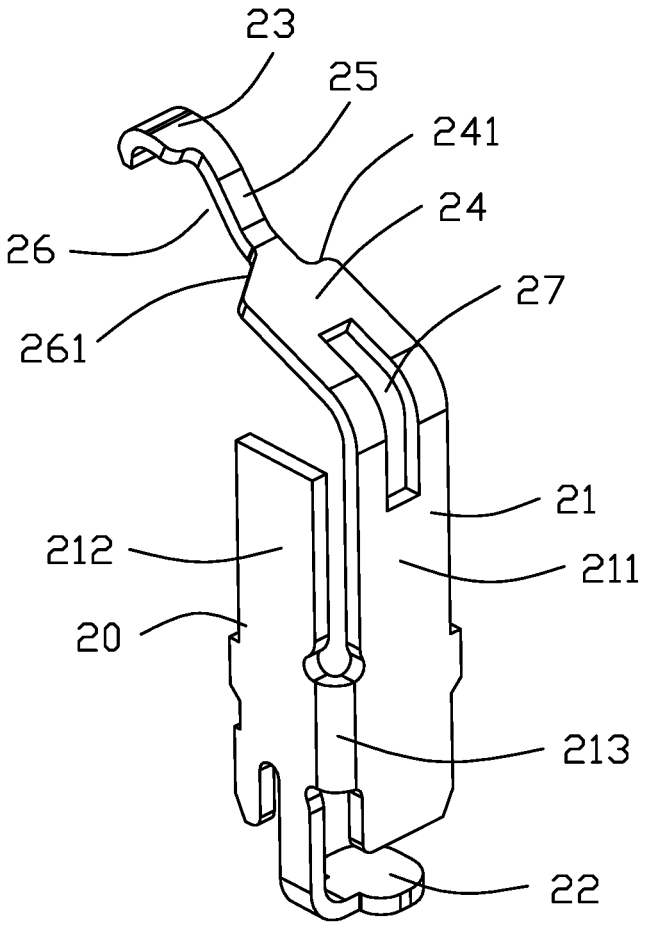
FIG. 3 is another perspective view of the electrical contact of the electrical connector of FIG. 1.
Figure 4:
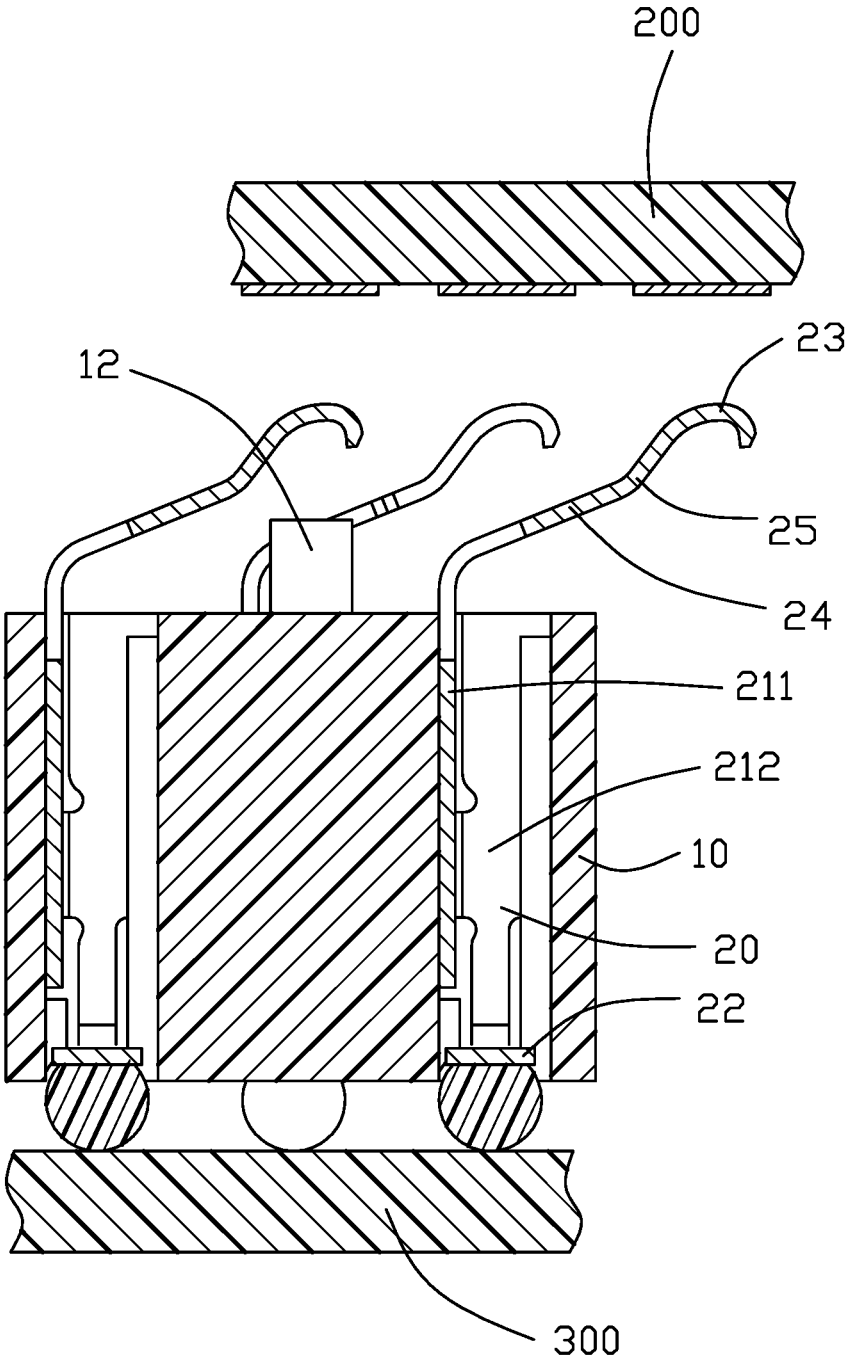
FIG. 4 is a cross-sectional view of the electrical connector and the associated electronic package of FIG. 1 and further a printed circuit board on which the electrical connector is mounted, when the electronic package is not mounted upon the electrical connector and the contacts are in a relaxed manner.
Figure 5:
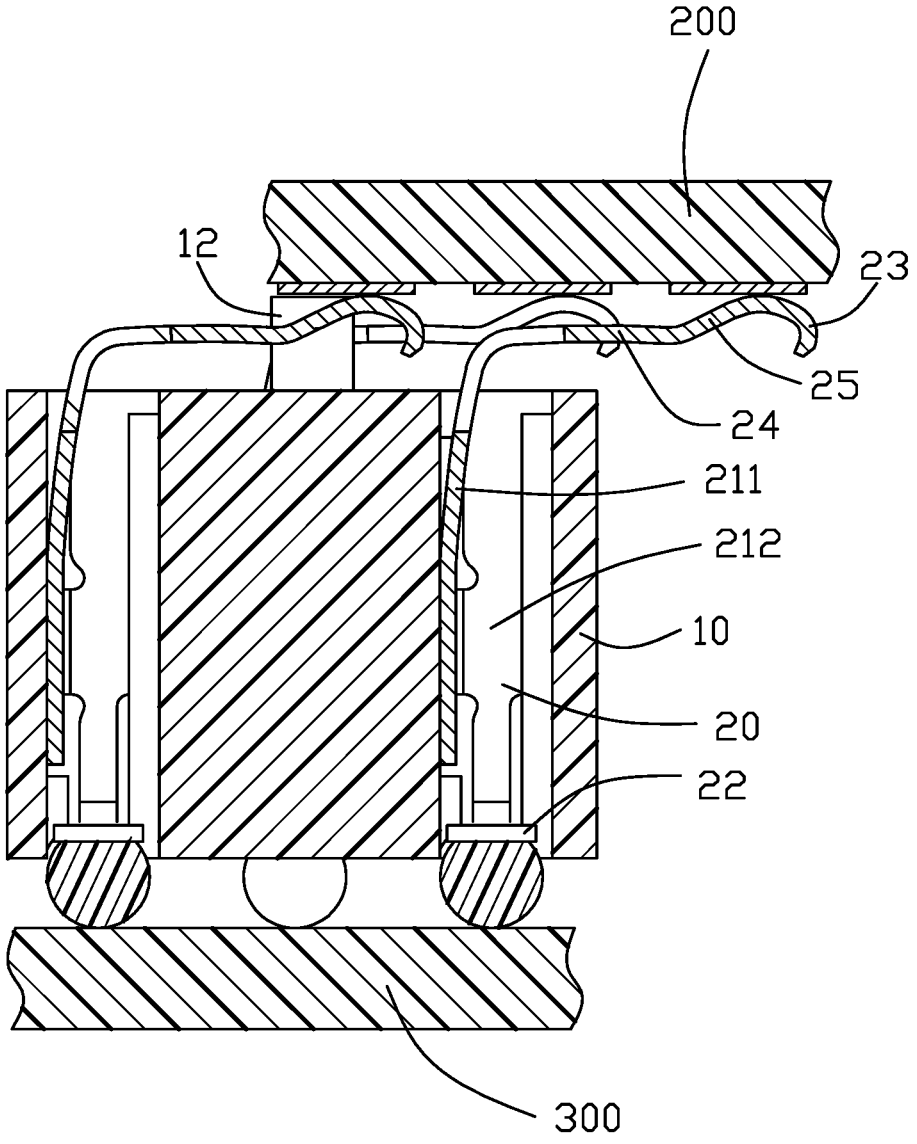
FIG. 5 is a cross-section view of the electrical connector with the associated electronic package and the printed circuit board of FIG. 4 wherein the electronic package is mounted upon the electrical connector and the contacts are downwardly deflected by the electronic package.
Figure 6:
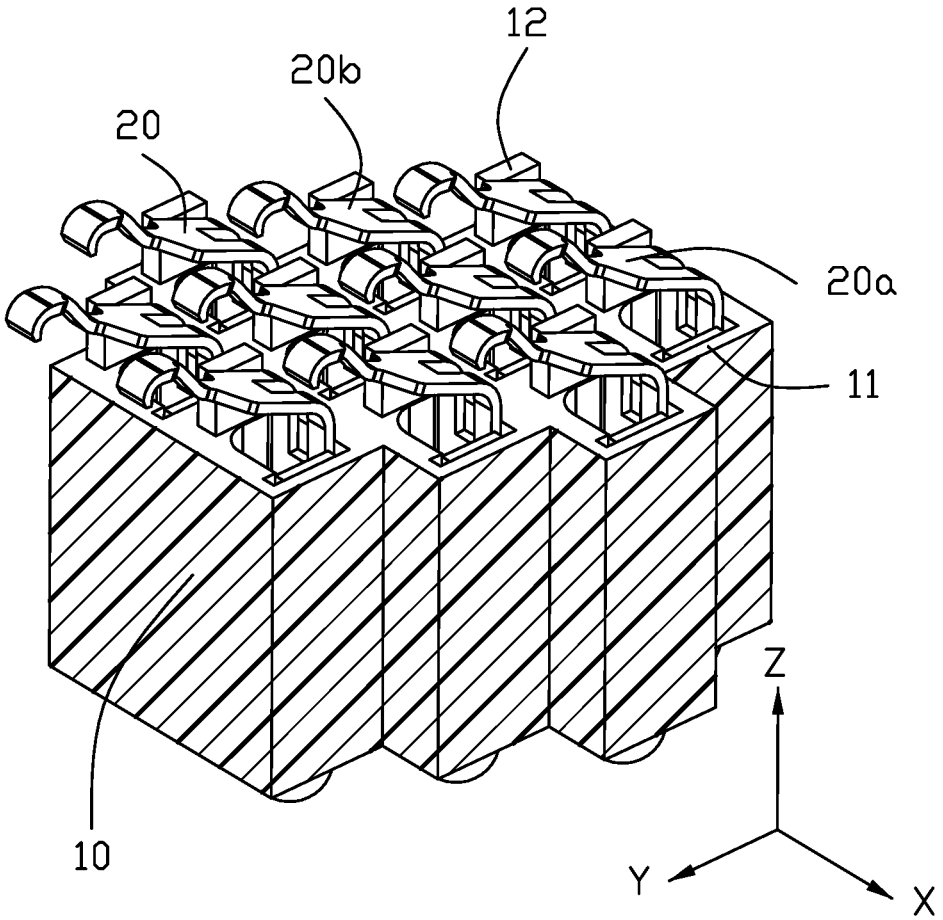
FIG. 6 a perspective view of a portion of the electrical connector of FIG. 1 when the contacts are in the relaxed manner.

The contact 20 further includes a plate/base section 24 extending upwardly from the top of the first body 211 in an oblique manner, and a curved/narrow connecting/middle section 25 linked between the enlarged/widened bugled contacting section 23 and the plate section 24. Understandably, all the plate 24, the connecting section 25 and the contacting section 23 commonly form a spring arm. In this embodiment, the connecting section 25 is originally configured to extend along the centerline of the spring arm. A notch 26 is formed in one side of the connecting section 25 for avoiding interference with the standoff 12 located around another passageway 11 in front of the contact 20. Generally speaking, because of the second body 212, the asymmetrically arranged connecting section 25 still functions well during deflection mechanically. In addition, because of asymmetrical arrangement of the connecting section 25 derived from the sided notch 26, a tapered structure 261 as shown in FIG. 3 is formed on one side of a front edge of the plate section 24. Differently, the other side of the front edge is essentially a horizontally extension 241 in the transverse direction X. It is also noted that in the transverse direction X, a width of the plate section 24 is larger than that of the contacting section 23 while equal to that of the first body 211. A slot 27 is formed from an upper region of the first body 211 to a middle region of the plate section 24. In this embodiment, the plate/base section 24 is flat for resulting in better capacitance effect during use. Anyhow, a slight curved configuration is also feasible.

As shown in FIGS. 4 and 6-8, before connecting to the electronic package 200, the plate section 24 extends upwardly and oblique. Notably, the passageways 11 and the corresponding contacts 20 are arranged in an offset manner with one half pitch along both the front-to-back direction Y and the transverse direction X. Therefore, the contacting section 23*a* of the rear contact 20*a* is aligned with the plate section 24*b* of the front contact 20*b* along the transverse direction X.

The invention is to increase the capacitance effect between the neighboring contacts 20 so as to lower the impedance thereof. In this embodiment, the plate section 24 and the contacting section 23 are specifically widened so as to enhance capacitance effect between/among the neighboring contacts 20. Anyhow, as mentioned earlier, the dimension increment of the spring arm may improperly increase its own rigidity so as not to meet the required resiliency thereof.

Figure 7:
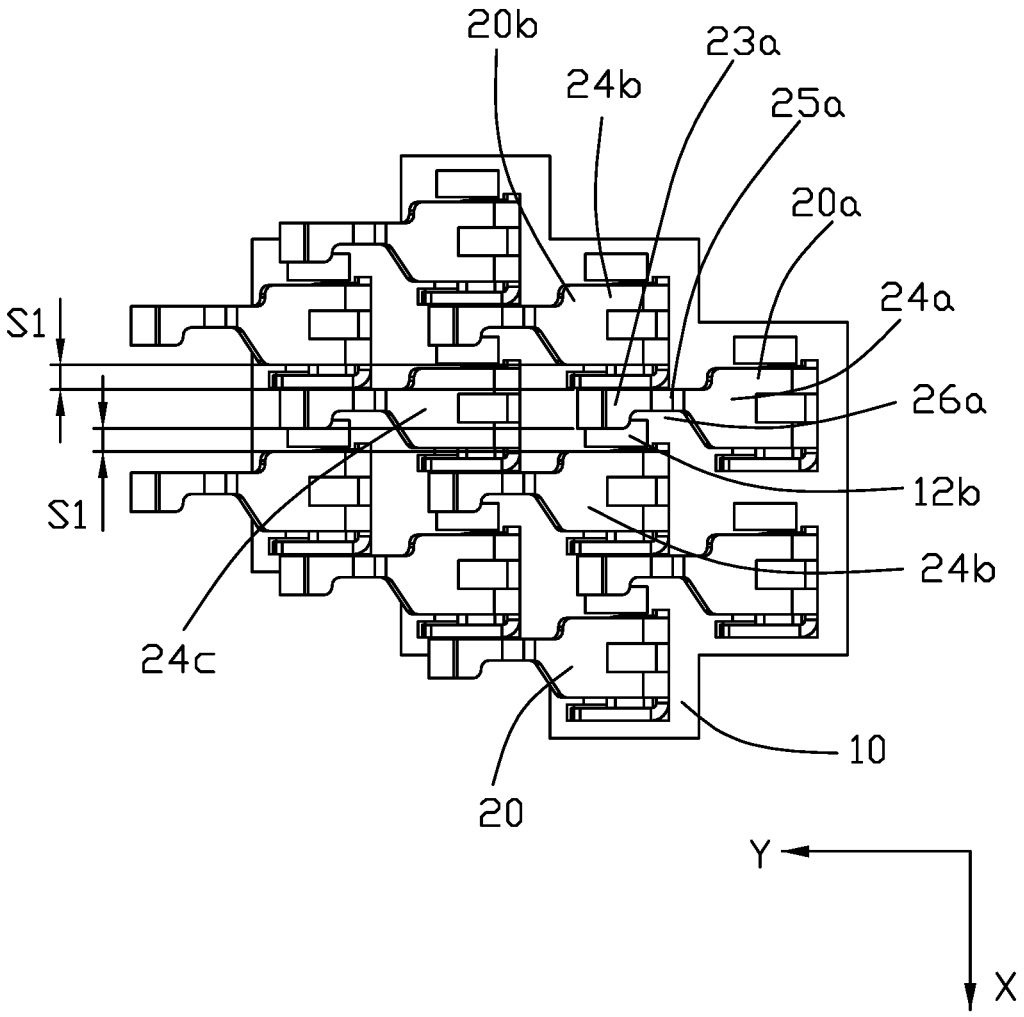
FIG. 7 is a top view of the portion of the electrical connector of FIG. 6.
Figure 8:
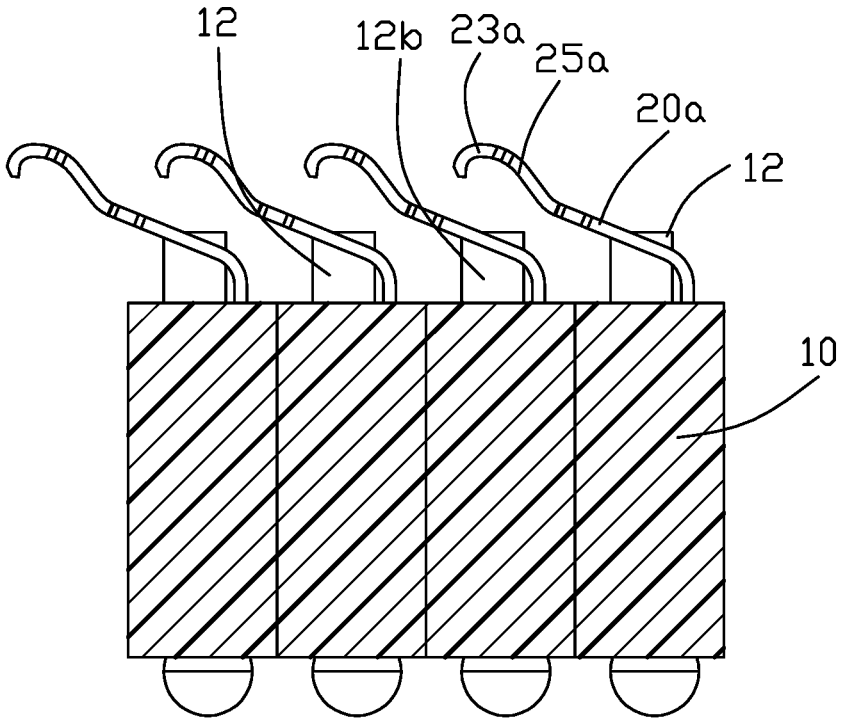
FIG. 8 is a side view of the portion of the electrical connector of the electrical connector of FIG. 6.
Figure 9:
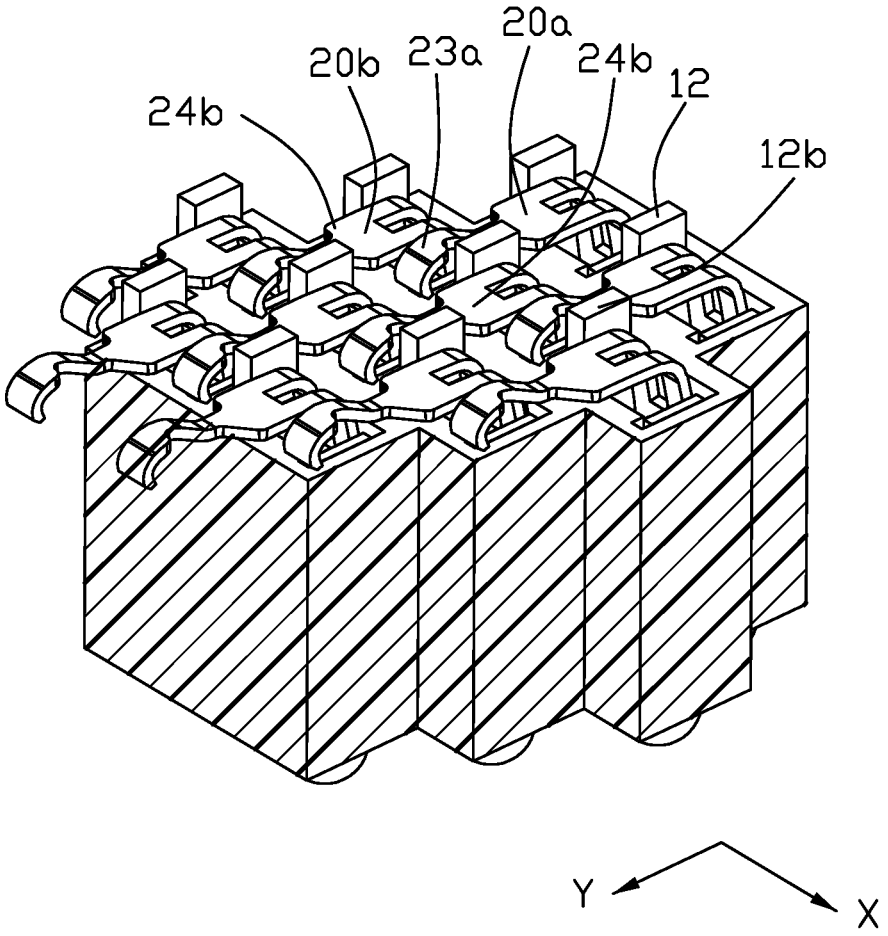
FIG. 9 is a perspective view of the portion of the electrical connector of FIG. 1 wherein the contacts are in a compressed manner.

As shown in FIG. 7, a distance S1 is formed between the contacting section 23*a* of the rear contact 20*a* and the plate section 24 of the front contact 20*b* in the transverse direction X. Understandably, the less the distance S1 is, the better the capacitance effect is. Anyhow, a too tiny distance may result in sparkling or shorting. Thus, the distance S1 is preferred between 0.12 mm and 0.16 mm and not beyond 0.18 mm.

The standoffs 12 are also arranged in matrix respectively corresponding to the contacts 20 so as to separate the plate sections 24 of the contacts from one another. As shown in FIG. 7, the contact section 23*a* of the rear contact 20*a* is partially overlapped with the corresponding standoff 12 in the vertical direction so as to allow dense arrangement of the contacts 20.

As shown in FIGS. 5 and 9-11, when the electronic package 200 is mounted upon the electrical connector 100, the spring arm including the contacting section 23, the connecting section 25 and the plate section 24, is downwardly moved so as to have the plate section 24 extend in a horizontal manner to be parallel to the top face of the housing 10. The distance between the contact section 23*a* of the rear contact 20*a* and a plate section 24*c* of the front contact 20 is S2 so as to form another capacitance effect. It results in the base capacitance effect among the contact section 23*a*, the plate section 24*b* and the plate section 24*c* when S1 is equal to S2. The connecting section 25*a* of the rear contact 20*a* is aligned with the plate section 24*b* of the front contact 20*b* in the transverse direction X. Notably, a length of the plate section 24 is similar to a sum of those of the contacting section 23 and the connecting section 25 along the front-to-back direction.

Figure 10:
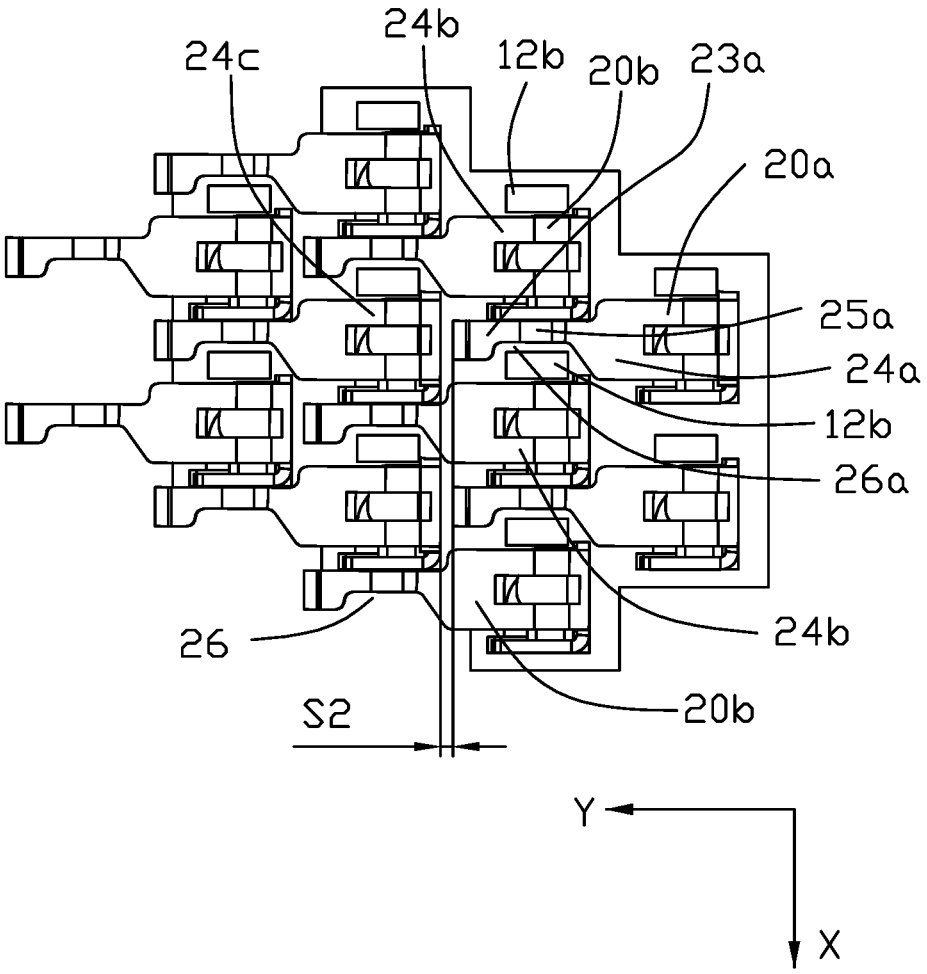
FIG. 10 is a top view of the portion of the electrical connector of FIG. 9.
Figure 11:
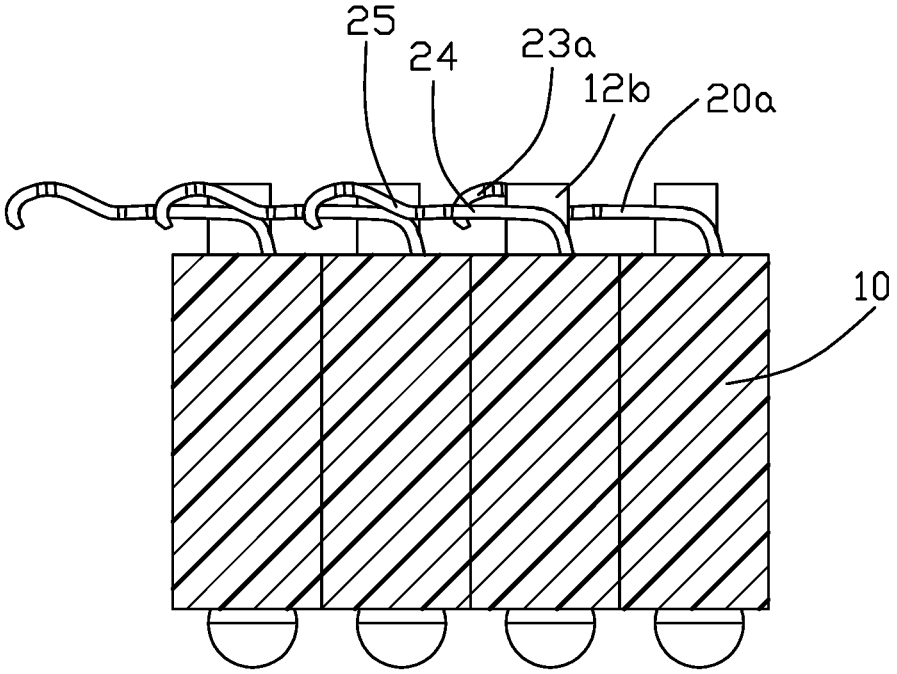
FIG. 11 is a side view of the portion of the electrical connector of FIG. 9.

It is also noted, when the contacting section 23 is downwardly pressed by the electronic package 200, the contacting section 23 of the rear contact 20*a* is downwardly moved and reaches a lower position which is offset, in the front-to-back direction Y, from the standoff 12*b* around the passageway 11 receiving the front contact 20*b*, even though such a contacting section 23 and the standoff 12*b* are partially aligned with each other in the front-to-tack direction Y. Simultaneously, the connecting section 25 of the rear contact 20*a* reaches a lower position which is offset, in the transverse direction, from such a standoff 12*b* in the transverse direction even though such a connecting section 25 and such a standoff 12*b* are aligned with each other in the transverse direction X. As mentioned before, the notch 26*a* in the connecting section 25 of the rear contact 20*a* is to receive the corresponding standoff 12*b* of the front contact 20*b*, and the standoff 12 is used to upwardly abut against the electronic package 200 for preventing excessive deflection of the contact 20. As shown in FIG. 10, a connecting section 25*a* of the rear contact 20*a* and the plate section 24*b* of the front contact 20*b* are commonly located between two standoffs 12*b* in the front row of the passageways 11 in the transverse direction. With this arrangement, the contacts 20 can be arranged in a relative dense manner while still keeping the required resilient force of the spring arm and the desired impedance of the contact.

The invention includes several features and advantages. The widened plate section 24 and the relatively widened contacting section 23, compared with the narrow connecting section 25, may provide the superior capacitance effect with the neighboring contacts. The widened contacting section 23 of the rear contact 20 is located between with the tiny distance S1 and aligned, in the transverse direction X, with the pair of plate sections 24 of the neighboring contacts 20 of the front row may enhance the capacitance effect therebetween. The widened contacting section 23 of the rear contact 20 is closely located, with a tiny distance S2, behind the plate section 24 of another neighboring contact 20 which is aligned with the rear contact in the front-to-back direction Y, thus enhancing the capacitance effect. The standoffs 12 are fully offset from the enlarged/widened contacting section 23 and the narrowed connecting section 25 of the neighboring contact 20 so as to allow the relatively dense arrangement of the contacts in matrix. In this embodiment, the standoff 12 is to separate the sprig arm of the contact received in the passageway 11 in the rear row from the plate section of the contact received in the neighboring passageway in the front row.

What is claimed is:

1. An electrical connector for use with an electronic package, comprising:

an insulative housing forming opposite top and bottom faces in a vertical direction and a plurality of passageways arranged in matrix with rows and extending through both said top face and bottom face in the vertical direction;

a plurality of contacts retained in the corresponding passageways, respectively, each of said contacts formed by sheet metal and including:

a first body and a second body sideward spaced from and angled with each other and linked to each other via a linking section;

a deflectable spring arm extending upwardly from an upper portion of the first body and including a wide plate section adjacent to the first body and a wide bulged contacting section at a top free end, and a narrow connecting section connected therebetween; wherein a width of the contacting section is larger than that of the connecting section while being smaller than that of the plate section.

2. The electrical connector as claimed in claim 1, wherein a plurality of standoffs are formed on the top face around the corresponding passageways, respectively, for upwardly abutment against the electronic package when the contacts are downwardly pressed by the electronic package.

3. The electrical connector as claimed in claim 2, wherein for each contact received in the corresponding passageway, the connecting section thereof forms a notch to receive the corresponding standoff located around the neighboring passageway for avoiding interference therebetween when the contacts are downwardly pressed by the electronic package.

4. The electrical connector as claimed in claim 2, wherein the connecting section forms a asymmetrical configuration with regard to a centerline of the spring arm.

5. The electrical connector as claimed in claim 2, wherein the spring arm extending in a first direction perpendicular to the vertical direction, while the first body lying in a plane defined by the vertical direction and a second direction perpendicular to both the vertical direction and the first direction.

6. The electrical connector as claimed in claim 5, wherein when the contacts are downwardly pressed by the electronic package, the contacting section of the contact received in the corresponding passageway in a rear row is located in front of the corresponding standoff around the neighboring passageway in a front row in an offset manner along the first direction, while the connecting section of said contact is located beside said corresponding standoff in another offset manner along the second direction.

7. The electrical connector as claimed in claim 6, wherein the connecting section of said contact in the rear row is aligned, along the second direction, with the plate section of the contact received in said corresponding neighboring passageway in the front row.

8. The electrical connector as claimed in claim 7, where a distance between the connecting section of said contact in the rear row and the plate section of said contact in the front row is between 0.12 mm and 0.16 mm.

9. The electrical connector as claimed in claim 5, wherein when the contacts are downwardly pressed by the electronic package, the contacting section of the contact received in the corresponding passageway in a rear row is located behind the plate section of the contact received in the corresponding passageway in a front row along the first direction.

10. The electrical connector as claimed in claim 9, wherein a distance between the contacting section of said contact received in the corresponding passageway in the rear row and the plate section of said contact received within the corresponding passageway in the front row is between 0.12 mm and 0.16 mm.

11. The electrical connector as claimed in claim 5, wherein the passageways is the rear row are offset from those in the front row with an half pitch offset in both the first direction and the second direction.

12. The electrical connector as claimed in claim 5, wherein when the electronic package is spaced from the contacts to have the contacts in a relaxed condition, the contacting section of the contact received within the corresponding passageway in a rear row is aligned, along the second direction, with the plate section of the contact received within the corresponding passageway in a front row.

13. The electrical connector as claimed in claim 1, wherein the plate section is parallel to the top face when the contact is downwardly deflected by the electronic package in a compressed manner.

14. An electrical connector for use with an electronic package, comprising:

an insulative housing forming opposite top and bottom faces in a vertical direction and a plurality of passageways arranged in matrix with rows and extending through both said top face and bottom face in the vertical direction;

a plurality of contacts retained in the corresponding passageways, respectively, each of said contacts formed by sheet metal and including:

a retaining part including at least a first body;

a deflectable spring arm extending upwardly from an upper portion of the first body and including a plate section adjacent to the first body and a bulged contacting section at a top free end, and a connecting section connected therebetween; wherein a plurality of standoffs are formed on the top face around the corresponding passageways, respectively, for upwardly abutment against the electronic package when the contacts are downwardly pressed by the electronic package; wherein the spring arm extending in a front-to-back direction perpendicular to the vertical direction, while the first body lying in a plane defined by the vertical direction and a transverse direction perpendicular to both the vertical direction and the front-to-back direction;

when the contacts are downwardly pressed by the electronic package in a compressed manner, the connecting section of the contact received within the corresponding passageway in a rear row and the plate section of the contact received in the corresponding neighboring passageway in a front row are commonly located, along the transverse direction, between a pair of standoffs in the front row.

15. The electrical connector as claimed in claim 14, wherein said retaining part further includes a second body linked to the first body via a linking section, and said second body lies in a plane defined by the vertical direction and the transverse direction.

16. The electrical connector as claimed in claim 15, wherein in each contact, the connecting section is narrowed than the contacting section.

17. The electrical connector as claimed in claim 16, wherein said in each contact, the connecting section forms a notch to receive the corresponding standoff when the contacts are downwardly deflected by the electronic package.

18. An electrical connector for use with an electronic package, comprising:

an insulative housing forming opposite top and bottom faces in a vertical direction and a plurality of passageways arranged in matrix with rows and extending through both said top face and bottom face in the vertical direction;

a plurality of contacts retained in the corresponding passageways, respectively, each of said contacts formed by sheet metal and including:

a retaining part including at least a first body;

a deflectable spring arm extending upwardly from an upper portion of the first body and including a plate section adjacent to the first body and a bulged contacting section at a top free end, and a connecting section connected therebetween; wherein a width of the contacting section is larger than that of the connecting section while being smaller than that of the plate section;

the connecting section is asymmetrical with regard to a centerline of the spring arm with a sideward notch so as to receive a corresponding standoff located around the neighboring passageway.

19. The electrical connector as claimed in claim 18, wherein said retaining part further includes a second body sideward linked to the first body with a linking section in a right angle manner, and said notch faces toward said second body.

20. The electrical connector as claimed in claim 19, wherein said notch defines a tapered configuration bordering the slide plate.

* * * * *